US005153561A

United States Patent [19]

Johnson

[11] Patent Number: 5,153,561

[45] Date of Patent: Oct. 6, 1992

[54] SECURED VALUABLE BOX FOR BEACH GOERS

[76] Inventor: Eric S. Johnson, 318 S. Commonwealth #206, Los Angeles, Calif. 90020

[21] Appl. No.: 584,780

[22] Filed: Sep. 19, 1990

[51] Int. Cl.[5] ..... G08B 13/06; G08B 13/14

[52] U.S. Cl. ..... 340/571; 70/278; 190/101; 361/172; 340/543

[58] Field of Search ..... 340/571, 543; 361/172; 190/101, 120; 150/101, 102; 70/278, 315

[56] References Cited

U.S. PATENT DOCUMENTS

| | | | |
|---|---|---|---|
| 1,291,051 | 1/1919 | McQuarrie | 340/571 |
| 3,551,906 | 12/1970 | Cooper | 340/571 |
| 4,117,468 | 9/1978 | Vasquez | 340/571 |
| 4,118,692 | 10/1978 | Fitchett | 340/542 |
| 4,155,079 | 5/1979 | Chiu et al. | 340/571 |
| 4,255,745 | 3/1981 | Rohan et al. | 340/546 |
| 4,267,553 | 5/1981 | Vogelsanger et al. | 340/571 |
| 4,272,763 | 6/1981 | Chang et al. | 340/571 |
| 4,426,862 | 1/1984 | Yamada et al. | 70/278 |
| 4,522,047 | 6/1985 | Johl | 70/278 |
| 4,688,025 | 8/1987 | Frank | 340/571 |
| 4,728,937 | 3/1988 | Hsu | 340/571 |
| 4,755,802 | 7/1988 | Urbanczyk | 340/571 |
| 4,833,456 | 5/1989 | Heller | 340/571 |
| 4,843,371 | 6/1989 | Kuei et al. | 340/539 |

*Primary Examiner*—Glen R. Swann, III
*Attorney, Agent, or Firm*—Plante Strauss & Vanderburgh

[57] ABSTRACT

A container, e.g., case or bag, has an internal compartment with an access opening that is entirely closed with a cover having a clasp that cooperates with a latch of an electronic lock carried on the container. Preferably, the cover carries a key pad on its external surface and the key pad is in circuit to an alarm system that includes a control unit, power supply, motion and/or shock detector, and an audible alarm such as a siren. Most preferably, the power supply comprises one and preferably a pair of panels of solar cells which are also located on an external surface of the top cover. The container has one or more handles which can include a shoulder carrying strap. Preferably the container is formed of a thermally insulating material so that the container also serves as a cooler for beverage cans and the like.

9 Claims, 2 Drawing Sheets

SECURED VALUABLE BOX FOR BEACH GOERS

BACKGROUND OF THE INVENTION

1. Field of Invention

This invention relates to a locked security box and, in particular, to a portable security box suitable for use by beach goers.

2. Brief Statement of the Prior Art

Locked portable boxes such as briefcases, bags, etc., have been proposed for various applications. There are quite a few prior attempts which have been made to provide attache or briefcases with an alarm. These cases have inconspicuous exteriors so that the existence of the alarm is not apparent. Some of these prior attempts have included repulsion systems such as high voltage shock systems. Examples of patents on such prior devices are the following U.S. Pat Nos. 4,843,371; 4,782,937; 4,272,763; 4,267,553 and 4,117,468.

A prior patent, U.S. Pat. No. 4,118,692, discloses a portable bag having an alarm device and an external latch for activation and deactivation of the alarm. This device protects against intrusion but not theft of the bag itself. Similar devices are shown in U.S. Pat. Nos. 4,755,802; 4,688,025; 4,255,745 and 1,291,051.

Some of the devices have been provided with a remote control which permits the user to activate and de-activate the alarm without contact with the box. While this is suitable for most applications, it is entirely unsuited for beach goers and swimmers who have no secure place to position the remote control.

An attempt to provide a motion sensor for attachment to items which are too bulky to be placed in a box, such as skis, is shown in U.S. Pat. No. 4,833,456, in which repetitive movements are required to activate the alarm.

The prior security devices for boxes compromise the capacity and bulk of the case or bag as they require the use of bulky battery packs to provide a dependable and constant source of electrical power for the alarm. Further, all of the prior devices have attempted to disguise alarms in otherwise conventional cases such as briefcases, attache cases, handbags and the like, rather than to provide a highly conspicuous container with obviously apparent security locks and alarms.

OBJECTIVES OF THE INVENTION

It is an object of this invention to provide a portable security container useful for swimmers, beach goers and the like.

It is a further object of this invention to provide a portable security device having obviously apparent locks and alarms.

It is a further object of the invention to provide the aforementioned portable security container with an alarm that is activated by a motion sensor.

It is also an object of the invention to provide the aforementioned portable security container with a key pad on an external surface suitable for alarm control and access.

It is an additional object of the invention to provide the aforementioned portable security container with at least one solar panel on an external surface, thereby minimizing the bulk and weight of the security system.

It is also a further object of the invention to provide the aforementioned security device in highly conspicuous and preferably fluorescent colors.

BRIEF STATEMENT OF THE INVENTION

This invention comprises a container, e.g., case or bag, having an internal compartment with an access opening that is entirely closed with a closure member having a clasp that cooperates with a latch of an electronic lock carried on the container. Preferably, the cover carries a key pad on its external surface and the key pad is in circuit to an alarm system that includes a microprocessor control unit, power supply, motion and/or shock detector, and an audible alarm such as a siren. Most preferably, the power supply comprises one and preferably a pair of panels of solar cells which are also located on an external surface of the top cover. The container has one or more handles which can include a shoulder carrying strap. Preferably the container is formed of a thermally insulated material so that the container also serves as a cooler for beverage cans and the like.

BRIEF DESCRIPTION OF THE DRAWINGS

The invention will be described with reference to the figures of which.

DESCRIPTION OF PREFERRED EMBODIMENT

Figure 1:
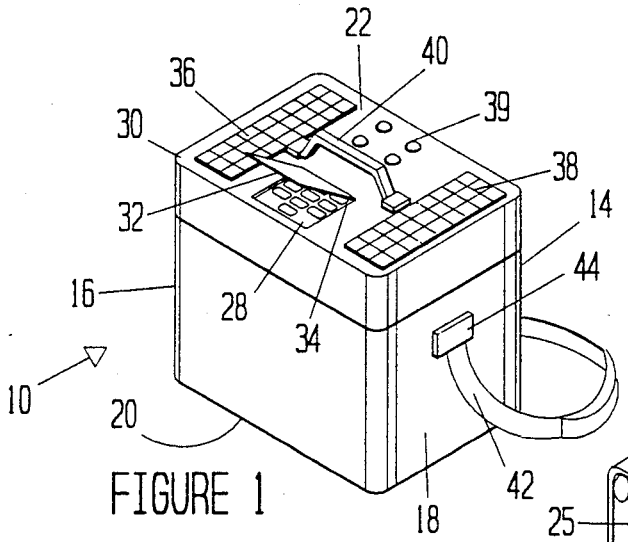
FIG. 1 is a perspective view of the container in its closed and locked configuration.
Figure 2:
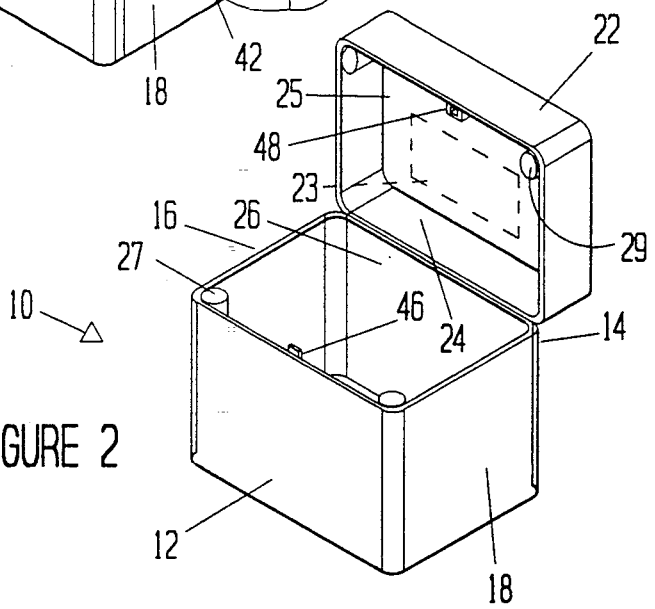
FIG. 2 is a perspective view of the container with the cover open.

Referring to FIGS. 1 and 2, the secured container of the invention comprises a portable box 10 having longitudinal side walls 12 and 14, opposite end walls 16 and 18, and a bottom wall 20 which are permanently secured and sealed together, preferably with an integral construction. The box 10 has a lid, or top cover 22 which, preferably, is hinged along one longitudinal side edge 24 to a longitudinal side edge 26 of the box. A key pad 28 is conspicuously located on the top surface 30 of the cover 22. The key pad 28 can be of various constructions or designs, preferably a membrane type key pad is used to provide protection against the environment. Beside the protection afforded by the membrane type key pad, if desired a supplemental key pad cover 32 can be hinged along a longitudinal edge 34 of the key pad 28 to provide additional protection.

Preferably, the top surface 30 of the cover 22 also supports a pair of solar panels 36 and 38 which are preferably symmetrically positioned at opposite ends of the cover 22. These solar panels are panels of conventional galvanic solar cells which are available in appropriate dimensions, voltage and power output sufficient to supply the requirements of the system.

A plurality of light emitting diodes (LED) 39 is provided in the top cover 22. As will be described in greater detail with reference to the circuit diagram of FIG. 4, these LEDs indicate the status of the container, and one LED is provided for each of the status indications of: (1) armed and locked or disarmed and unlocked; (2) tampering; (3) program mode; and (4) battery low.

The portable box 10 is provided with one or more carrying handles such as the handle 40 that is pivotally attached to the top surface 22 of the cover to provide a hand grip for carrying of the box. Alternatively, the box can be provided with a carrying strap 42 having its ends distally secured to attachment brackets 44 located on the exterior surfaces of the opposite end walls 16 and 18 of the box 10.

FIG. 2 illustrates the portable box 10 with the cover 22 opened, revealing the interior. The box 10 carries a suitable clasp 46 which is engaged by a cooperative latch 48 of the electrical lock on cover 22.

Figure 3:
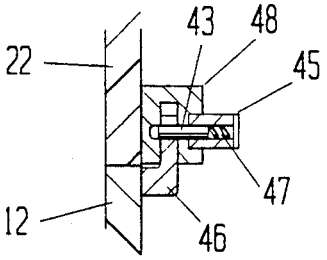
FIG. 3 is an enlarged sectional view through the lock mechanism of the container.

As shown in FIG. 3, the latch 48 has a latch pin 43 that is resiliently biased into a closed or locked position by spring 47 of solenoid 45, and that is unlocked against the bias of the resilient spring by the energization of solenoid 45. To permit a momentary signal applied to the solenoid 45 to release the cover, resilient means such as springs of compressible plastic or rubber foam columns 29 can be located in opposite, inside front corners of the cover 22, seating against bases 27 in the box 10.

The box 10 includes a suitable alarm such as a high audible output siren that is internally mounted. Preferably, the siren is mounted on the printed circuit board 23 for the container (see FIG. 2), and the printed circuit board 23 is mounted on the inside of cover 22. For this purpose, the cover 22 can have a protective liner 25 which extends across its undersurface and overlies and protects the printed circuit board 23.

As described hereinafter, the container also has a standby power supply that is maintained in a charged condition by the solar panels 36 and 38, thereby precluding the possibility of disarming of the device by covering the solar cells. For this purpose, a small rechargeable battery such as a 9-volt nickel/cadmium rechargeable can be used. Preferably all the active circuit components are mounted on the inside of the top cover 22 of the container 10.

Figure 4:
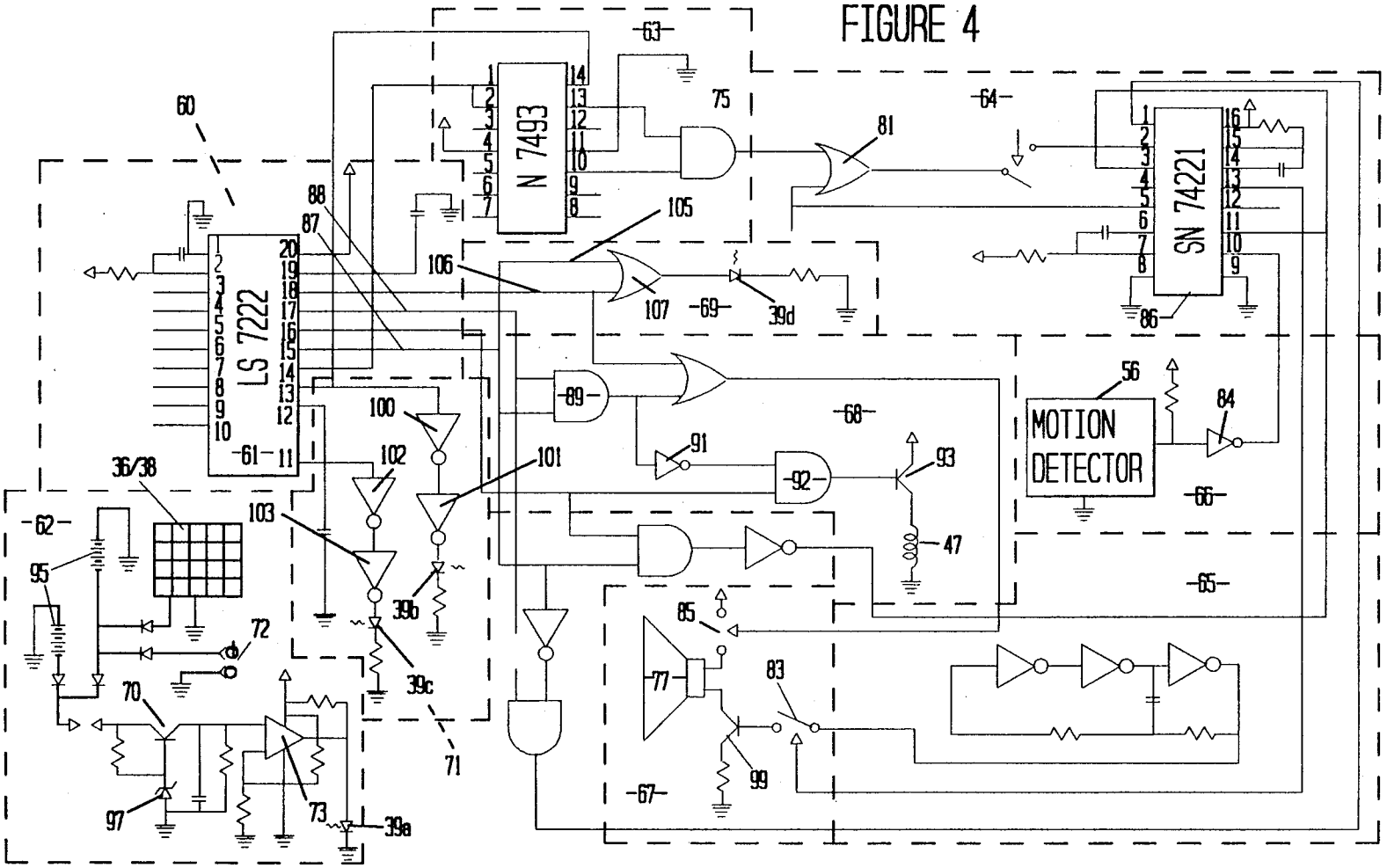
FIG. 4 is a block diagram of the electronic and alarm circuits.

Referring now to FIG. 4, the alarm circuit and control circuit of the system will be described. The circuit comprises ten component circuits which are enclosed in the dashed lines of the illustration. Briefly these are the programmable electronic lock circuit 60, power supply and battery status circuit 62, counter circuit 63, dual pulse delay circuit 64, oscillator 65, motion sensor circuit 66, speaker circuit 67, unlock circuit 68, arm/disarm circuit 69, and status circuit 71.

The control for the circuit is a key pad 28 (FIG. 1) which is connected in circuit to the input terminals 3–10 of the programmable electronic lock, which is an integrated circuit 61 that contains the necessary memory, decoder and control logic circuits. A useful IC circuit is LS 7322, a programmable digital lock circuit from LCI Components, Inc., 1235 Walt Whitman Road, Melville, N.Y. 11747. The output signals from this circuit are applied to each of the other circuits as described hereinafter.

The voltage from batteries 95 is applied to switch transistor 70 in the power supply and battery status circuit 62, having its base grounded through Zener diode 97. When the battery voltage falls below a safe value, set by the value of the Zener diode 97, operational amplifier 73 conducts, lighting LED 39*a*, which indicates a low battery condition.

The counter circuit 63 receives pulses from the tamper output pin 14 of the electronic lock integrated circuit 61. The counter circuit 63 is set to generate an output signal at ANDGATE 75 when it receives a binary value of 101 or decimal 5 pulses. A suitable counter circuit is available as S7493 from Signetics, Inc.

The output signal from the counter circuit 63 is applied to NANDGATE 81 and the output from NANDGATE 81 is applied to the an input terminal 2 of the timer circuit 86 in the dual pulse delay circuit 64. A suitable timer circuit is SN74221 from Texas Instruments. This timer circuit 86 controls the duration of the alarm signal from the circuit, preferably from about 60 to about 300 seconds.

The oscillator circuit 65 is a conventional circuit to pulse the alarm circuit at a selected and desirable frequency. The alarm system has a motion detector 56 which can be of various designs or construction, e.g., piezoelectric device, mercury switch, or an electromagnetic device such as a magnet and pickup coil. The detector, e.g., the coil of an electromagnetic pickup device, is connected through invertor 84 to the enable terminal 10 of timer circuit 86 in the dual pulse delay circuit 64.

The output signal generated in the dual pulse delay circuit 64 is applied to an electronic switch 83 in the speaker circuit 67, which closes to apply the oscillator signal to the base of switch transistor 99. When the container is locked, a signal from the unlock circuit 68 is applied to the electronic switch 85 in the speaker circuit 67 which closes, so that when switch 83 is closed and the oscillator signal is applied to the base of transistor 99, an oscillating signal is applied across the speaker 77, generating a high pitched alarm tone, which has a frequency determined by oscillator 65 and a duration controlled by the duration of the signal from the timer circuit 86 of the dual pulse delay circuit 64.

The solenoid 47 of the lock mechanism is in circuit with output leads 87 and 88 from the electronic lock integrated circuit 61. These outputs are applied to ANDGATE 89 having its output applied through invertor 91 and ANDGATE 92 to the base of switch transistor 93. When the output of ANDGATE 92 goes high, transistor 93 is biased into conducting, applying power to the coil of the solenoid 47, withdrawing pin latch 43 from the clasp 46.

The status circuit 71 includes LEDs to indicate whether the container is locked and armed (LED lighted); unlocked and disarmed (LED unlighted); whether the circuit has detected tampering; and to indicate when the circuit is being programmed. For this purpose, output signals are applied from the electronic lock integrated circuit 61 through inverting buffers 100, and 101 to LED 39*b* and through inverting buffers 102 and 103 to LED 39*c*. These LEDs indicate that the status of the container is "PROGRAM", i.e., being programmed, or the container is being or has been tampered with by an improper sequence of keyboard entries.

The arm/disarm circuit 69 also includes output leads 105 and 106 which extend to NANDGATE 107 to activate the armed LED 39*d*when the container has been closed and the alarm circuit has been activated by entry of the proper code sequence through the keyboard 28.

The power supply and battery status circuit 62 includes rechargeable emergency standby batteries 95, a charging circuit with an input socket 72 for the charging of the batteries 95 from household current, and the aforementioned solar panels 36 and 38. The socket 72 can be conveniently and inconspicuously located on the container, preferably in the cover 22, immediately adjacent the printed circuit board 23.

The programs of the circuit can be the following: (1) arm; (2) disarm; (3) reset; (4) variation in alarm duration; and (5) sensitivity of motion detection. Code sequences are provided for setting these programs. At least the first three of these programs are provided in all embodiments, and the preferred embodiment provides all five programs.

The box 10 can be formed of any suitable material, preferably of plastic, and can be injection molded, thermoformed or rotationally molded, depending on the selected material. The case can be lined with a suitable insulation, e.g., closed cellular foam such as polystyrene, polyurethane foam, and the like or, alternatively, the entire case could be fabricated of a cellular foam material, e.g., polyurethane. As previously mentioned, it is preferred that the sidewalls and bottom of the box 10 be of unitary, integral construction. Preferably, the box has a highly visible appearance and, for this purpose, various fluorescent colors, indicative of beachgoers', or California styles, can be molded into the case or coated on the container after its fabrication.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A portable container for valuables which comprises:

a. a closed receptacle having a interior chamber with an access opening in its top surface;

b. a to cover hinged to said receptacle and moveable between an open position and a closed position totally closing said opening;

c. a lock including a latch carried on said top cover and cooperative with a clasp carried on said receptacle;

d. resilient means in said lock biasing said latch into a locked engagement with said clasp, and a solenoid carried on said container and cooperative with said lock to release said lock against the bias of said resilient means;

e. a keypad carried on said top cover at a location exposed to view and free access;

f. an electrical power supply carried by said container; and g. an alarm and control circuit carried on said top cover and in circuit with said power supply, keypad and solenoid including storage means whereby a code can be stored in said alarm and control circuit and accessed through said keypad to activate said solenoid;

h. alarm means carried by said container;

i. motion detection means also carried by said top cover and in circuit between said power supply, alarm and control circuit and said alarm means, whereby said keypad can arm said alarm to respond to a signal from said motion detection means, or disarm said alarm.

2. The container of claim 1 whereby said keypad is the only operator-input device for said alarm and control circuit.

3. The container of claim 1 wherein said receptacle is a box formed entirely of cellular plastic foam to provide thermally insulating walls to provide a portable cooler.

4. The container of claim 1 wherein said keypad is carried on the top surface of said top cover.

5. The container of claim 1 wherein said power supply includes a panel of solar cells carried on the top surface of said top cover.

6. The container of claim 1 including a carrying handle on said top cover of said container.

7. The container of claim 6 wherein said handle is centrally located on said cover.

8. The container of claim 1 wherein said receptacle is a box with opposite end side walls and including a carrying strap attached to said opposite end walls of said container.

9. The container of claim 8 wherein opposite ends of said strap are attached to said opposite end walls of said container.

* * * * *